US012137823B1

(12) United States Patent
Xhurxhi

(10) Patent No.: US 12,137,823 B1
(45) Date of Patent: Nov. 12, 2024

(54) PIZZA DISPLAY CASE

(71) Applicant: VERACE ARTISAN PIZZA, LLC, Miami, FL (US)

(72) Inventor: Denis Xhurxhi, Miami, FL (US)

(73) Assignee: VERACE ARTISAN PIZZA, LLC, Miami, FL (US)

( * ) Notice: Subject to any disclaimer, the term of this patent is extended or adjusted under 35 U.S.C. 154(b) by 0 days.

(21) Appl. No.: 18/329,973

(22) Filed: Jun. 6, 2023

(51) Int. Cl.

| | |
|---|---|
| ***A47F 7/00*** | (2006.01) |
| ***A45C 11/20*** | (2006.01) |
| ***A45C 15/04*** | (2006.01) |
| ***A45C 15/06*** | (2006.01) |
| ***A47F 11/10*** | (2006.01) |

(52) U.S. Cl.
CPC ..... *A47F 7/0071* (2013.01); *A45C 11/20* (2013.01); *A47F 11/10* (2013.01); *A45C 15/04* (2013.01); *A45C 15/06* (2013.01)

(58) Field of Classification Search
CPC ..... A45C 3/02; A45C 11/20; A45C 15/04; A45C 15/06; A47F 3/001; A47F 7/0071; A47F 11/04; A47F 11/10
See application file for complete search history.

(56) References Cited

U.S. PATENT DOCUMENTS 2,487,883 A * 11/1949 Le Baron ..... A45C 15/06 132/288
2,758,900 A * 8/1956 Marchand ..... A45C 15/06 312/328
3,381,119 A * 4/1968 Brickman ..... A45C 15/06 D26/56
4,139,955 A * 2/1979 Reiback ..... G09F 13/12 359/857
5,833,352 A * 11/1998 Goodwin ..... A45C 15/06 362/156
6,433,313 B1 * 8/2002 Owens ..... H05B 1/0252 219/387
2014/0008265 A1 * 1/2014 Ruggiero ..... G06Q 30/0241 53/458

(Continued)

OTHER PUBLICATIONS https://blog.nightlifesuppliesusa.com/2022/06/bottle-presenters-for-bottle-service.html (Year: 2022).*

(Continued)

*Primary Examiner* — Alexander K Garlen
(74) *Attorney, Agent, or Firm* — ALBERT BORDAS P.A.

(57) ABSTRACT

A pizza display case for showcasing pizzas attractively and conveniently. It includes a base assembly and a lid assembly. The base assembly having a base dish and accompanying walls and surface that provide support and create a cavity. The lid assembly, positioned above the base assembly, features an upper surface, walls, and a bottom surface with lights and a lid mirror. The lights trace the edge of the lid mirror, illuminating the pizzas within and enhancing visibility. The base dish is removable for easy placement and removal of pizzas. A base lock on the front wall secures the lid assembly, and hinges enable smooth opening and closing. Customization is facilitated by the base dish, lid mirror, and front wall. Additional features include lights on the walls and adjustable lighting controlled by a switch. Overall, the case offers a versatile and visually appealing solution for showcasing pizzas.

10 Claims, 3 Drawing Sheets

(56) References Cited

U.S. PATENT DOCUMENTS

| | | | | |
|---|---|---|---|---|
| 2014/0306587 | A1* | 10/2014 | Pun | A45C 5/005<br>312/226 |
| 2019/0110573 | A1* | 4/2019 | DeCarlo | A45C 11/008 |
| 2022/0313012 | A1* | 10/2022 | Ganahl | A47J 36/38 |

OTHER PUBLICATIONS

Nightlife2: https://web.archive.org/web/20230130170724/https://nightlifesuppliesusa.com/light-up-briefcase-special-serving-briefcase-custom-logo/ (Captured: Jan. 30, 2023) (Year: 2023).*

* cited by examiner

PIZZA DISPLAY CASE

BACKGROUND OF THE INVENTION

1. Field of the Invention

The present invention relates to pizza containers, and more particularly, to a pizza container that displays pizzas.

2. Description of the Related Art

Applicant is not aware of any other prior art suggesting the novel features of the present invention.

SUMMARY OF THE INVENTION

The instant invention is a pizza display case comprising a base assembly and a lid assembly. The pizza display case is designed to showcase and hold at least one pizza in an attractive and functional manner.

The base assembly comprises a base left wall, base right wall, base front wall, base rear wall, and a base recessed surface, which collectively provide support for a base dish and create a base recessed cavity. The base dish securely holds at least one pizza and can be easily removed from the base assembly.

The lid assembly includes a lid upper surface, lid left wall, lid right wall, lid front wall, lid rear wall, and a lid bottom surface. The lid bottom surface features lid lights and a lid mirror, whereby the lid lights trace the outer edge of the lid mirror, illuminating the pizzas within the base recessed cavity and enhancing their visibility. The lid lights are integrated into the lid bottom surface, positioned to create a depth of field effect when viewing the lid mirror.

To facilitate opening and closing, the base rear wall incorporates hinges that are attached to the lid rear wall, allowing for easy attachment and detachment of the lid assembly from the base assembly. The base front wall features a base lock that securely fastens the lid assembly to the base assembly. In terms of customization, the base dish accommodates various shapes and sizes, allowing for pizza customizations. The lid mirror and base front wall provide space for depictions or descriptions. Additional features include base lights located on the respective walls, as well as a base handle attachment point on the base front wall for attaching a base handle. The base right wall and lid right wall comprise a base light switch and a lid light switch, which control the brightness of the base lights and lid lights respectively. A remote can be used to adjust the brightness and hue of the base lights and lid lights remotely. The pizza display case provides a convenient and visually appealing solution for showcasing and holding pizzas, with features such as removable base dish, lid lights with a lid mirror, customizable space for depiction or description, adjustable lighting options, and easy attachment and detachment of the lid assembly.

It is therefore one of the main objects of the present invention to provide a pizza display case that effectively showcases and holds pizzas in an attractive and functional manner.

It is another object of this invention to provide a pizza display case that allows for easy placement and removal of pizzas by featuring a removable base dish within the base assembly.

It is another object of this invention to provide a pizza display case that enhances the visibility of the pizzas within the base recessed cavity by incorporating lid lights and a lid mirror, creating an illuminated and visually appealing display.

It is another object of this invention to provide a pizza display case that offers customizable options for pizza configurations, accommodating various shapes and sizes through the base dish, allowing for pizza customizations.

It is another object of this invention to provide a pizza display case that is volumetrically efficient for carrying, transporting, and storage.

It is another object of this invention to provide a pizza display case that can be readily assembled and disassembled without the need of any special tools.

It is another object of this invention to provide a pizza display case which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
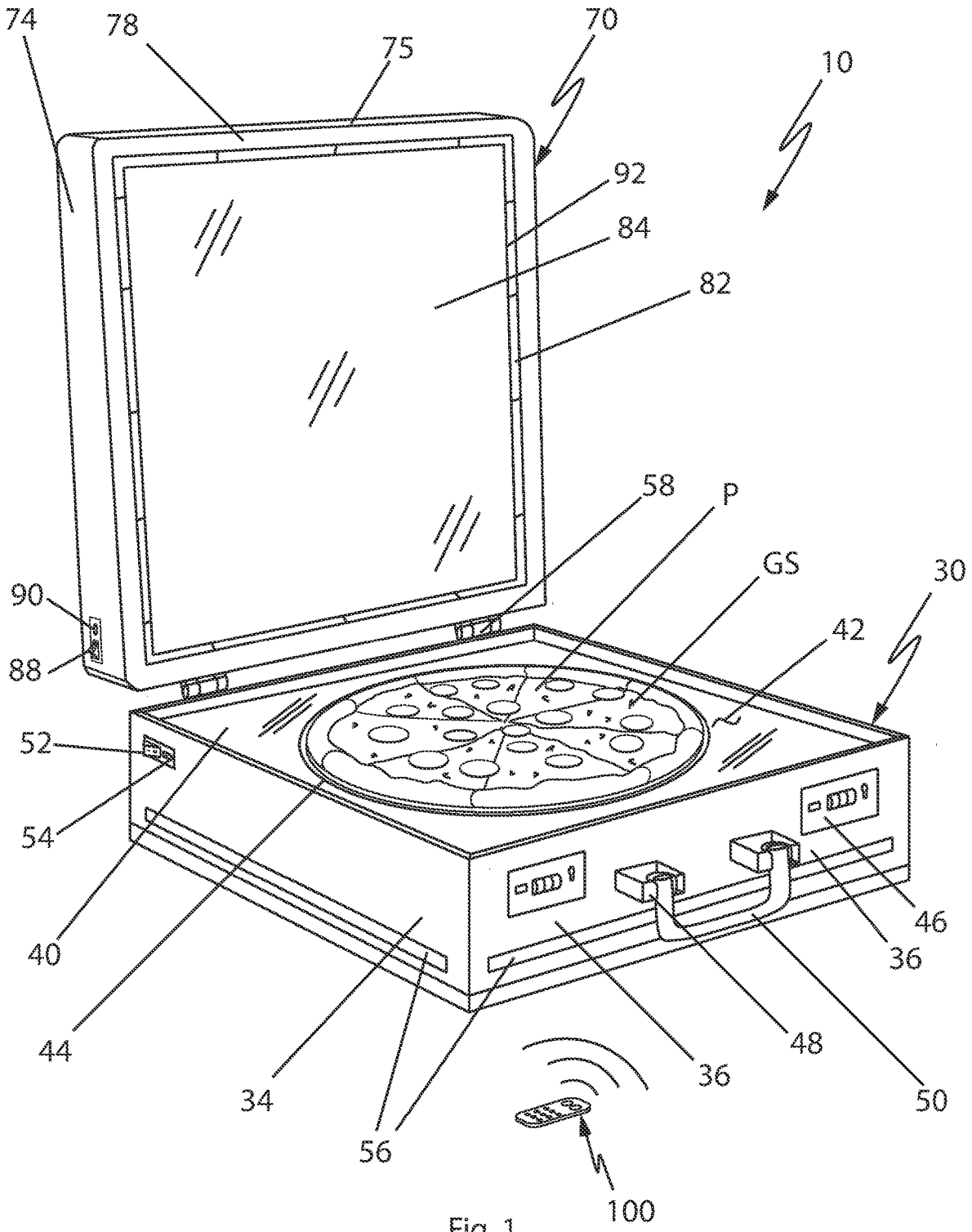
FIG. 1 represents an isometric view of the present invention.

Referring now to the drawings, the present invention is generally referred to with numeral 10. It can be observed that it basically includes base assembly 30 and lid assembly 70.

Figure 2:
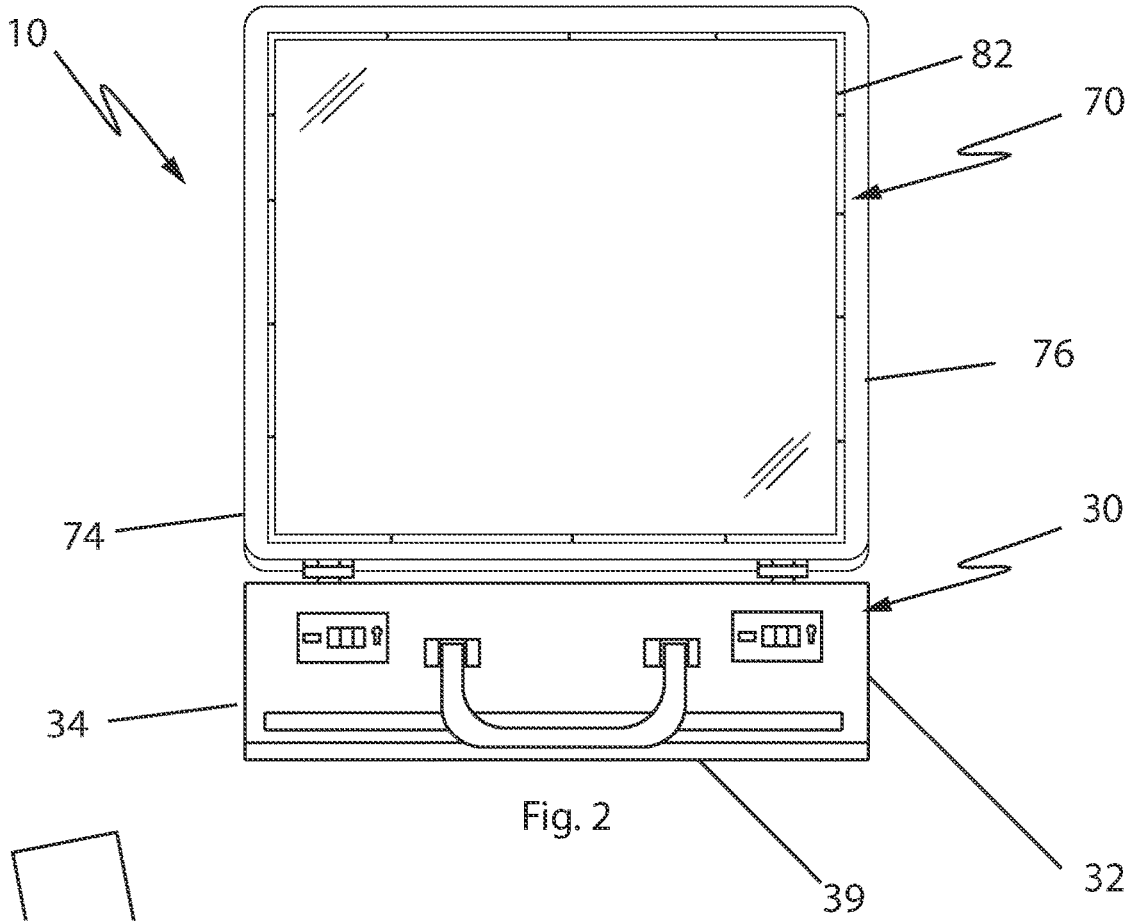
FIG. 2 is a front view of the present invention.
Figure 3:
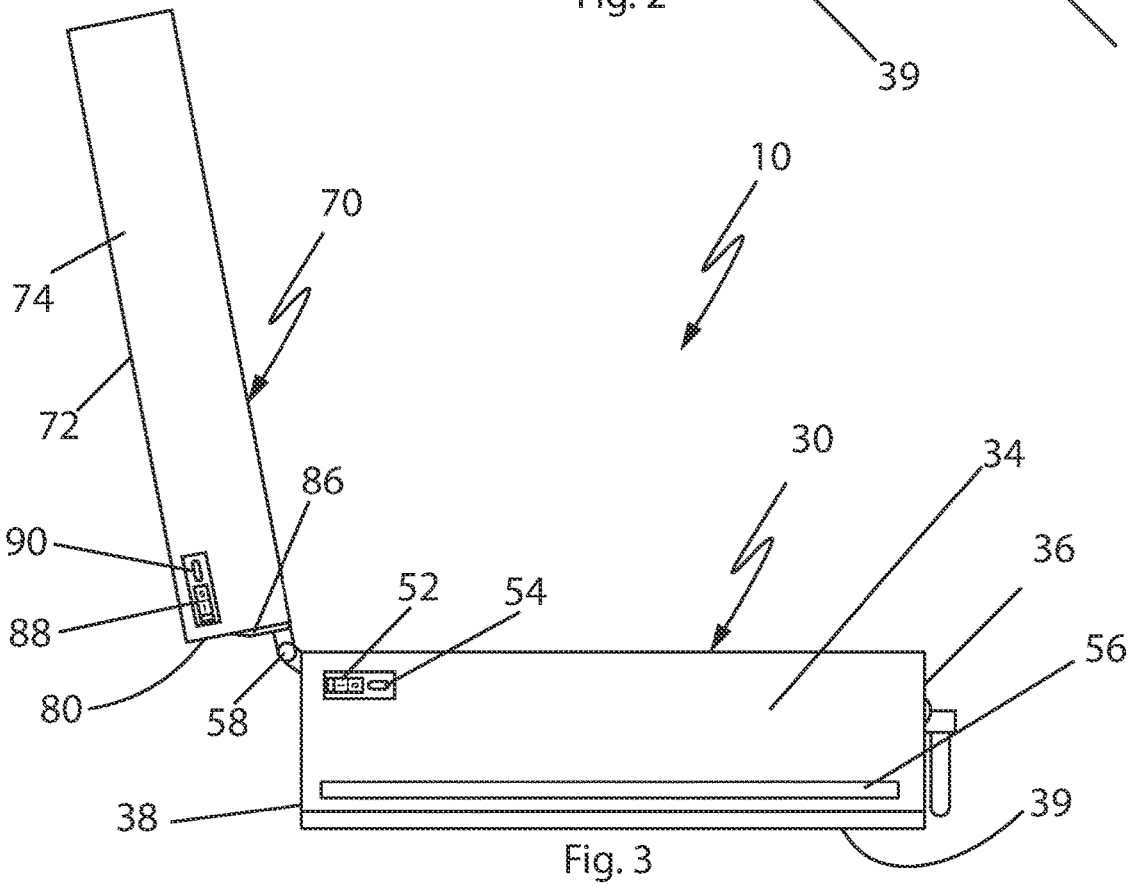
FIG. 3 is a right-side view of the present invention.

As seen in FIGS. 1 and 2, base assembly 30 comprises base left wall 32, base right wall 34, base front wall 36, base rear wall 38, seen in FIG. 3, base bottom surface 39, and base recessed surface 40, which collectively provide support for base dish 44 and create base recessed cavity 42. Base dish 44 securely holds at least one pizza P and can be easily removed from base assembly 30. Lid assembly 70 comprises lid upper surface 72, seen in FIG. 3, lid right wall 74, lid left wall 76, lid front wall 75, lid rear wall 80, seen in FIG. 3, and lid bottom surface 78. Lid bottom surface 78 features lid lights 82 and lid mirror 84, whereby lid lights 82 trace lid mirror edge 92, illuminating pizza P within base recessed cavity 42 and enhancing its visibility. Lid lights 82 are also integrated into lid bottom surface 78, positioned to create a depth of field effect when viewing lid mirror 84. Base front wall 36 features base lock 46 that securely fastens lid assembly 70 to base assembly 30. In terms of customization, base dish 44 accommodates various shapes and sizes, allowing for pizza P customizations. Lid mirror 84 and base front wall 36 provide space for depictions or descriptions. Additional features include base lights 56 on base front wall 36, base left wall 32, seen in FIG. 3, and base right wall 34, as well as base handle attachment point 48 on base front wall 36 for attaching base handle 50. Remote 100 can be used to adjust brightness and hue of base lights 56 and lid lights 82 remotely. Although not illustrated, present invention 10 comprises at least one receiver to receive wireless communications from remote 100. In a preferred embodiment, lid lights 82 are light emitting diodes, but may come in a variety of lighting variations such as incandescent light bulbs.

Figure 4:
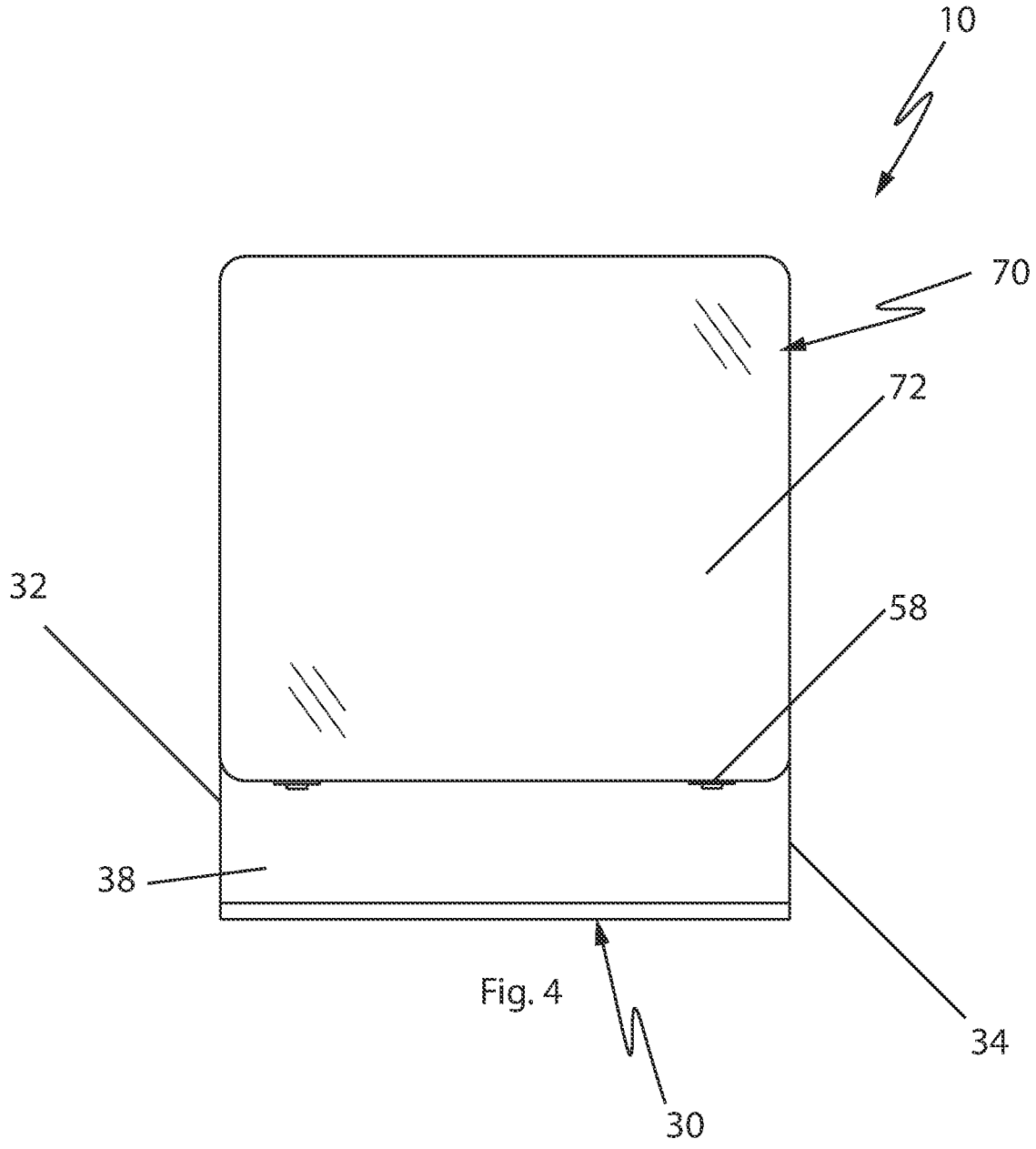
FIG. 4 is a rear view of the present invention.

As seen in FIGS. 3 and 4, base right wall 34 and lid right wall 74 comprise base light switch 52 and lid light switch 88 respectively, which control brightness of base lights 56 and lid lights 82, seen in FIG. 2, respectively. Base right wall 34 and lid right wall 74 comprise base charging port 54 and lid charging port 90. Although not illustrated, base charging port 54 and lid charging port 90 connect to and charge a rechargeable battery that is used to power base lights 56 and lid lights 82. To facilitate opening and closing of lid assembly 70 onto base assembly 30, base rear wall 38 incorporates hinges 58 that are attached to lid rear wall 80 at lid hinge attachment points 86, allowing for easy attachment and detachment of lid assembly 70 from base assembly 30.

In one embodiment, gold sprinkles GS, as seen in FIG. 1, are sprinkled on pizza P for visual appeal. Pizza P can come in different shapes, sizes, and varieties along with varying toppings. In a preferred embodiment, base recessed surface 40 and base dish 44 are gold and shiny, creating a visually appealing look around said pizza P. It is understood that the present invention 10 can be longer or wider to accommodate more than one pizza, for example, present invention 10 can be longer to accommodate two pizzas P side-by-side.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

The invention claimed is:

1. A pizza display case comprising:

A) a base assembly having at least one base dish for at least one pizza, said base assembly comprises a base left wall, a base right wall, a base front wall, a base rear wall, and a base recessed surface, which securely supports and holds said at least one base dish, said at least one base dish securely holds said at least one pizza, said at least one base dish is removable from said base assembly, said base assembly further comprises base lights, a base light switch, and a base charging port, whereby said base light switch controls intensity of said base lights; and B) a lid assembly comprising a lid upper surface, a lid left wall, a lid right wall, a lid front wall, a lid rear wall, and a lid bottom surface comprising lid lights and a lid mirror, whereby said lid lights trace an outer edge of said lid mirror, illuminating said at least one pizza within said base recessed cavity, said lid assembly further comprises a lid light switch and a lid charging port, whereby said lid light switch controls intensity of said lid lights.

2. The pizza display set forth in claim 1, further characterized in that said base left wall, base right wall, base front wall, and base rear wall collectively provide support for said base recessed surface, resulting in formation of a base recessed cavity.

3. The pizza display set forth in claim 1, further characterized in that said lid lights are integrated into said lid bottom surface and positioned in such a way to create a depth of field when viewing said lid mirror.

4. The pizza display set forth in claim 1, further characterized in that said base rear wall comprises hinges, whereby said hinges are attached to said lid rear wall, allowing for said lid assembly to pivot on said hinges.

5. The pizza display set forth in claim 4, further characterized in that said hinges allow for said lid assembly to attach and detach from said base assembly.

6. The pizza display set forth in claim 1, further characterized in that said base front wall comprises at least one base lock, whereby said at least one base lock secures said lid assembly to said base assembly.

7. The pizza display set forth in claim 1, further characterized in that said lid mirror and said base front wall have space for a depiction or a description.

8. The pizza display set forth in claim 1, further characterized in that said at least one base dish accommodating a plurality of shapes and sizes allowing pizza customizations.

9. The pizza display set forth in claim 1, further characterized in that said base front wall comprises at least one base handle attachment point, whereby at least one base handle attaches to said at least one base handle attachment point.

10. The pizza display set forth in claim 1, further characterized in that a remote remotely controls intensity and hue of said base lights and lid lights.

* * * * *